United States Patent [19]

Uchihashi

[11] Patent Number: 4,958,981

[45] Date of Patent: Sep. 25, 1990

[54] ATTACHMENT CONNECTOR ASSEMBLY FOR HYDRAULIC SHOVEL TYPE EXCAVATOR

[76] Inventor: Masatoshi Uchihashi, 223, Oaza Michibe, Mikazuki-machi, Ogi-gun, Saga-ken, Japan

[21] Appl. No.: 286,711

[22] Filed: Dec. 20, 1988

[51] Int. Cl.[5] ..... E02F 3/36

[52] U.S. Cl. ..... 414/694; 294/86.41; 414/697; 414/723

[58] Field of Search ..... 294/68.23, 86.4, 86.41, 294/88, 104–107; 37/103, 117.5, 183 R, 184, 188, DIG. 3; 414/687, 694, 695.5, 697, 705, 707, 710, 715, 718, 723, 724, 726, 729, 732, 735, 738–740, 776, 783, 912, 920

[56] References Cited

U.S. PATENT DOCUMENTS

| | | | |
|---|---|---|---|
| 2,678,741 | 5/1954 | Pilch | 414/697 X |
| 3,038,620 | 6/1962 | Collin | 294/107 X |
| 3,116,845 | 1/1964 | Holopainen | 414/726 X |
| 3,231,116 | 1/1966 | Powell | 414/694 |
| 3,413,029 | 11/1968 | Donovan | 294/68.23 |
| 3,664,527 | 5/1972 | Short | 414/718 X |
| 3,920,137 | 11/1975 | McCain | 294/68.23 X |
| 4,005,894 | 2/1977 | Tucek | 294/86.41 X |
| 4,017,114 | 4/1977 | LaBounty | 294/88 X |
| 4,542,929 | 9/1985 | Possinger | 294/68.23 X |

*Primary Examiner*—Johnny D. Cherry
*Attorney, Agent, or Firm*—Jones, Tullar & Cooper

[57] ABSTRACT

A versatile connector assembly for various types of attachments is provided for use with hydraulic shovel type excavators. The connector permits a rotational movement of the attachment and comprises a connector head connected to a stick arm or dipper stick of the excavator for controlled pivotal movement and a rotating member disposed for rotation relative to the connector head and including a swivel joint fitted in the rotating member. A fitting plate member having firmly secured thereto a mounting structure for the attachment is removably secured to the rotating member. A hydraulic drive motor may be located on the connector head in driving relationship to the rotating member.

3 Claims, 5 Drawing Sheets

ATTACHMENT CONNECTOR ASSEMBLY FOR HYDRAULIC SHOVEL TYPE EXCAVATOR

BACKGROUND OF THE INVENTION

The invention relates to an attachment connector assembly for use with hydraulic shovel type excavators and, more particularly, to such an assembly which enables an easy and precise adjustment of the orientation of the attachment as needed for handling materials such as rocks, dirt, logs, tree stumps and the like at a job site. The invention also relates to a grapple or bucket device used in combination with such a connector assembly.

Hydraulic shovel type excavators find applications in the field of civil engineering and construction. One type of such excavators is a backhoe which may be typically designed to suit working conditions wherein materials to be handled are located considerably under the ground level on which the backhoe is situated. The backhole typically comprises a stick arm or dipper stick to which various types of attachments can be selectively connected in order to carry out efficiently and effectively a wide variety of operations such as excavating, loading and offloading.

Various types of attachments are known in the art, including a grapple device having incorporated therein a rotating mechanism for providing controlled rotational movement of the grapple jaws relative to the grapple body about an axis of rotation thereof. This type of grapple device may be particularly advantageous in certain situations. For example, in demolishing a building, steel bars embedded in a reinforced concrete block are cut by grasping the reinforced concrete block by the grapple jaws and then twisting it through the rotation of the grapple jaws. Also, logs stacked in random orientations can be sucessfully handled because grapple jaws may be positively rotated to any position about the rotating axis. However, this type of grapple device has several drawbacks. First, the need to incorporate a rotation mechanism into each grapple device will not only increase the complexity of the grapple device but also add to the manufacturing costs. Secondly, any critical failure of the grapple jaws will necessitate replacement of the entire grapple device, even if the rotating mechanism functions properly. p Another well known type of attachment is a bucket device which is attached to a backhoe arm for a limited range of pivotal movement. The existing bucket devices, however, have limited capabilities; that is, the combined action of a boom, an arm and bucket cylinders permits the bucket device to be pulled only towards the backhole for excavation. Also, with the boom and arm of the backhoe in their raised position, the ability for the bucket device to excavate would be inherently limited.

It is an object of the present invention to provide an attachment connector assembly for use with hydraulic shovel type excavators, which permits an easy and precise adjustment of the orientation of the attachment as needed for handling various types of materials.

It is another object of the invention to provide an attachment connector assembly which permits easy removal and replacement of the attachment when damaged.

It is a still further object of the invention to provide a grapple or bucket device for use in combination with a connector assembly as mentioned above.

SUMMARY OF THE INVENTION

Broadly stated, the present invention provides an attachment connector assembly for use with a hydraulic shovel type excavator, comprising: connector head means connected to a stick arm or dipper stick of the excavator for controlled pivotal movement about a first axis, rotating means mounted to the connector head assembly for rotation relative to the head means about a second axis and including a mounting structure to which an attachment is removably attached, the second axis extending substantially transverse to the first axis, and drive means operatively associated with the rotating means to controllably rotate the rotating means and thus attachment about the second axis.

The mounting structure comprises a fitting plate member removably secured to the rotating means, and a pair of hollow mounting boss means secured to the fitting plate member in spaced apart relationship to each other for insertion of mounting pin means. Preferably, the mounting boss means are supported by support bracket means spaced apart from each other lengthwise of the boss means and integrally joined to the fitting plate member. The mounting boss members extend through the support bracket members.

The connector assembly according to the present invention can use any type of attachment as needed, and provided a rotational movement of the attachment. Thus, the attachment to be utilized may be of a type having no built-in rotating mechanism.

Preferably, the drive means comprises at least one hydraulic motor located on the connector head means and fluidly connected to a hydraulic fluid source, and a gearing mechanism composed of a pinion gear connected to the output of the hydraulic motor and a toothed wheel mounted on the rotating means in engagement with the pinion gear, thereby providing a controlled rotational movement of the rotating means and thus the attachment attached thereto about the second axis during the actuation of the hydraulic motor.

Preferably, at least one hydraulic cylinder is pivotally connected to the mounting structure and the rod member of the hydraulic cylinder is adapted to be operatively connected for extension and retraction relative to the attachment. The number of the hydraulic cylinders may be determined so as to allow the use of a clam shell type grapple.

Preferably, one of the mounting boss means is shorter than the other boss means. A pair of support leg means is pivotally connected through pivot pin means to said one of the mounting boss means at opposite side thereof. The support leg means have integrally joined thereto a third boss means substantially similar to the other boss means. The support leg means each have a length such that the attachment can be set in its approproate position.

Preferably, means is provided for interconnecting the attachment with the mounting structure of the rotating means. The interconnecting means comprises lever means connected at a first point for pivotal movement to one of said mounting boss means of the mounting structure and connected at a second point to the attachment. The rod member of the hydraulic cylinder is pivoted to the lever means at a point situated between said first and second points of the lever means thereby providing a pivotal movement of the attachment through said interconnecting means about said first point during the extension or retraction of the rod member of the hydraulic cylinder.

BRIEF DESCRIPTION OF THE DRAWINGS

The invention will be better understood from the following detailed description of preferred embodiments of the invention, when taken in conjunction with the accompanying drawings, in which.

DESCRIPTION OF PREFERRED EMBODIMENTS

Figure 1:
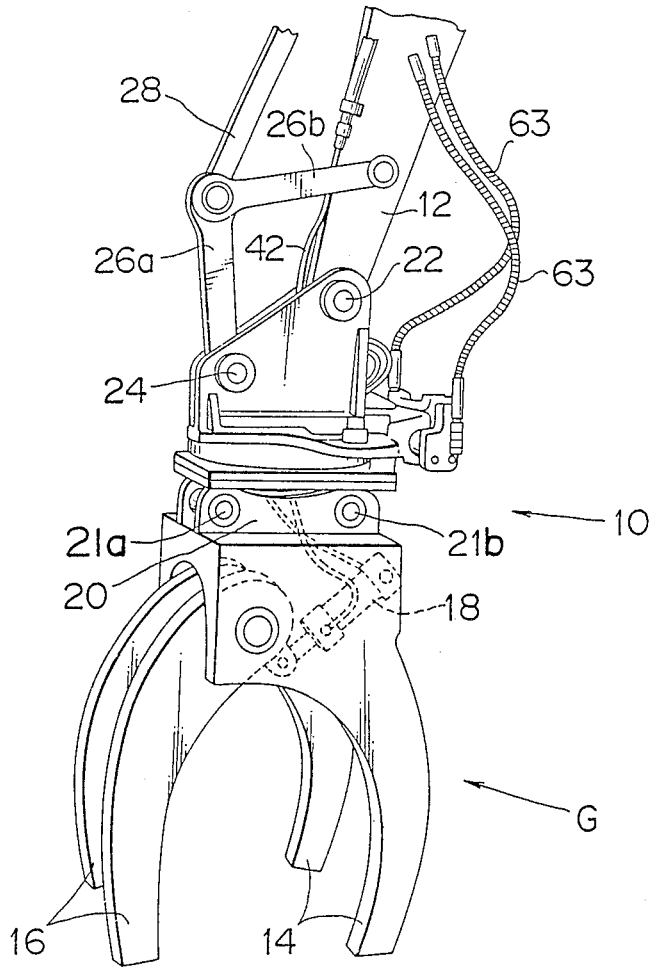
FIG. 1 is a perspective view showing an attachment connector assembly according to the present invention as attached to a backhoe arm, with a grapple attached to a mounting structure of the connector assembly.

In the following description, like reference numerals designate same or corresponding parts throughout the several figures of the drawings, and terms such as "forward", "rearward", "left", "right", "upwardly", "downwardly", and the like are used as words of convenience not to be construed as limiting terms.

Referring now to the drawings, particularly to FIG. 1, there is shown an improved attachment connector assembly, generally designated by 10, which is pivotally connected in a conventional manner to a stick or excavator arm or dipper stick 12 of a hydraulic shovel type excavator such as a backhole (not shown). A typical grapple G is removably attached to the bottom of the connector assembly 10. The grapple G essentially consists of a pair of fixed jaws 14 and a pair of movable jaws 16 connected to the fixed jaw pair 14 for pivotal movement between their open and closed positions. A hydraulic cylinder 18 is incorporated in the grapple to control the pivotal movement of the movable jaw pair 14 relative to the fixed jaws. The grapple further includes a suspension structure comprising a pair of integrally formed, spaced apart brackets 20 adapted for pin connection to a mounting structure of the attachment connector assembly 10. Typically, the brackets 20 have two spaced apart holes for receipt of respective mounting pins **21*a* and 21*b*, as shown in FIG. 1. The connector assembly 10 is conventionally pivoted, on one hand, at 24 to a linkage 26*a* which in turn is operatively connected to a rod 28 of a hydraulic cylinder (not shown) on the excavator arm 12 and also to another linkage 26*b* linking to the stick arm 12. With this arrangement, it would be apparent to those skilled in the art that the connector assembly 10 along with the attached grapple G can be generally pivotally moved about the pivot axis defined by the pin 22 of the stick arm within a limited range of angular displacement under the control of the hydraulic cylinder unit through the linkages 26*a* and 26*b* in a vertical plane defined thereby. The operation of the controlled pivotal movement of the attachment connector assembly 10 relative to the excavator arm or stick arm 12 is well known and therefore will not be described herein further. In place of the grapple G as shown, other conventional types of attachments such as a clam-type grapple, bucket or the like may be used with the connector assembly 10** according to the invention without requiring any significant modifications to the mounting structure of the connector assembly, as will be described hereinafter in detail.

Figure 2:
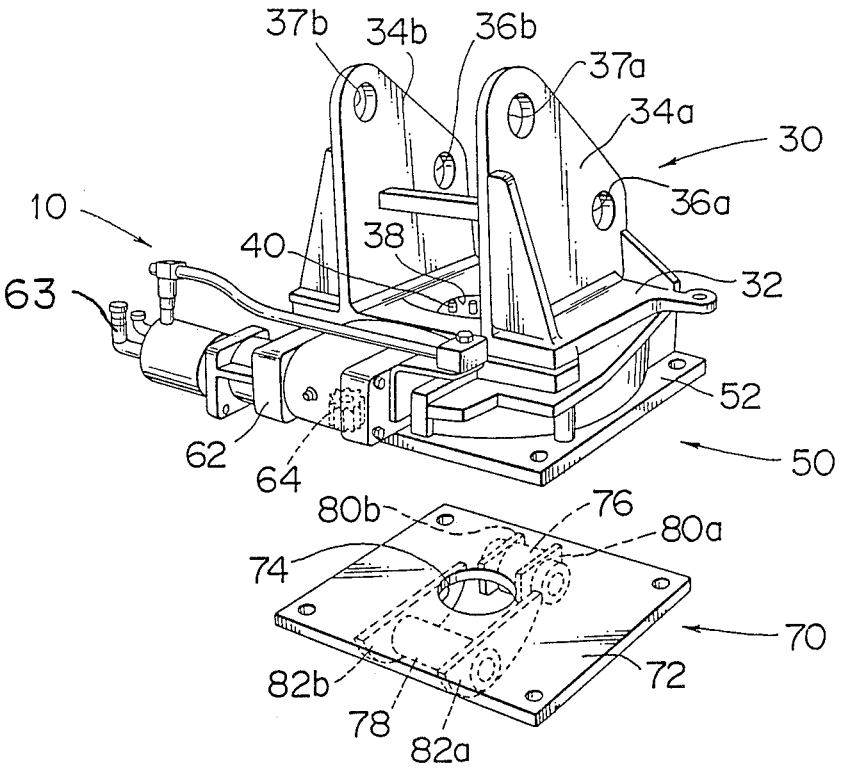
FIG. 2 is an exploded perspective view of the attachment connector assembly of FIG. 1, showing a mounting structure for the attachment in a separate manner.

As best seen in FIG. 2, the connector assembly 10 according to the invention comprises a connector head portion, generally designated by 30, which includes a generally rectangular base plate member 32 and a pair of generally parallel side plate members **34*a* and 34*b* integrally formed with and extending generally vertically from the upper surface of the base plate 32. The side plates 34*a* and 34*b* are spaced apart from each other by a distance enough to receive therebetween the distal end of the stick or arm 12 of the excavator, as shown in FIG. 1. The side plate members 34*a* and 34*b* are each provided with holes 36*a* and 37*a*, 36*b* and 37*b*, respectively. The corresponding holes 36*a* and 36*b*, and also 37*a* and 37*b* in the side plates are aligned with each other to permit insertion of respective mounting pins 22 and 24, thereby providing for the pivotal movement of the connector head portion 30 and thus the whole connector assembly 10 relative to the stick arm 12, as mentioned above. Centrally located in the base plate 32 is an opening 38 which receives a conventional swivel joint 40 fluidly connecting hoses or lines 42** (only one of which is shown in FIG. 1) to a hydraulic fluid source (not shown).

Figure 3:
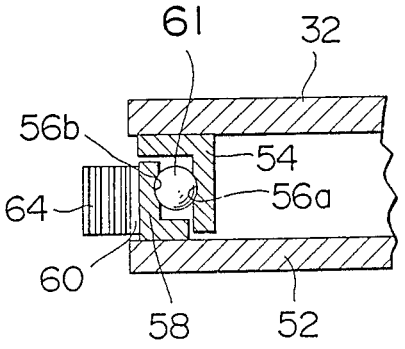
FIG. 3 is a partially sectioned view of a gearing mechanism by which a rotating member can be rotated relative to a connector head.

Disposed beneath the connector head portion 30 is a rotating element 50 in the form of a rectangular plate member 52 which is provided with a central opening (not shown) in alignment with the central opening 38 of the plate 32. The swivel joint 40 extends into and fittingly engages the central openings to make the plate member 52 freely rotatable about its axis of rotation through 360 degrees relative to the connector head portion 30. As shown in FIG. 3, the base plate 32 is provided on its underside with an annular depending wall member 54 which surrounds the center opening 38 and preferably has a continuous circumferential recess **56*a* formed in the outer surface thereof. On the other hand, the plate 52 of the rotating element 50 is provided on the top thereof with a corresponding, annular, upwardly extending wall member 58 which surrounds the annular depending wall 54 of the plate 32. The annular wall 58 includes a continuous circumferential recess 56*b* formed in the inside surface thereof opposite to the recess 56*a* of the depending wall member 54. The wall member 58 is spaced apart from the wall member 54 so as to define therebetween an annular space for confining a plurality of roller balls 61 (only one of which is shown in FIG. 3). Preferably, the roller balls 61 are retained in the opposed recesses 56a and 56b of the wall members 54 and 58, respectively, in order to allow smooth rotational movement of the plate member 52 relative to the base plate 32 of the connector head part 30 with small friction generated between during rotation. The wall member 58 preferably is in the form of a wheel having external gear teeth 60. Rotation of the plate member 52 can be accomplished by the actuation of a hydraulic drive such as a hydraulic motor 62 fluidly connected via fluid lines 63 to a hydraulic fluid source (not shown). The hydraulic motor is located on one of the sides of the base plate 32 of the connector head 30. As shown, the hydraulic motor 62 includes a pinion gear 64 which is mounted on the drive shaft thereof to drivingly engage the externally toothed wheel 58. Advantageously, an additional hydraulic motor (not shown) may be disposed on the opposite side of the base plate 32 from the hydraulic motor 62 in a manner similar to the latter, in order to prevent any possible significant damage to gear teeth 60 and 64** which would otherwise be likely to be caused in handling heavy materials, for example, twisting steel bars in a reinforced concrete block, by use of the grapple.

Referring again to FIG. 2, an attachment mounting subassembly, generally designated by 70, comprises a fitting plate member 72 having a central opening 74 in alignment with the openings of the rotating plate and base plate members 52 and 32 for passage of the hoses 42 therethrough to the cylinder 18 and adapted to be removably but firmly secured to the underside of the plate member 52 as by bolting (not shown), and a mounting structure carried by the fitting plate member 72. The mounting structure includes a pair of hollow, open-ended mounting bosses or shafts 76 and 78 each having a predetermined length substantially identical to, or slightly less than, the spacing between the suspension brackets of the attachment and laterally spaced apart by a distance identical to the spacing between the holes in the attachment brackets. Each of the bosses is supported at different positions by respective support bracket members 80a and 80b, 82a and 82b which are rigidly secured to the underside of the fitting plate member 72, respectively, as by welding. Alternatively, the mounting structure may be welded directly to the underside of the rotating plate member 52 without the use of the fitting plate member 72. However, the provision of the fitting member 72 is preferable in that the present attachment connector assembly may employ a variety of mounting subassemblies designed specifically for the suspension structures of other types of attachments. The hollow shafts 76 and 78 extend through their respective support bracket members 80a and 80b, 82a and 82b, respectively, and open at their respective open ends in order to permit insertion of the pins 21a and 21b therethrough for mounting of the grapple G, as shown FIG. 1. It can be understood that either open end of the boss 76 is substantially flush with the corresponding open end of the boss 78.

Figure 4A:
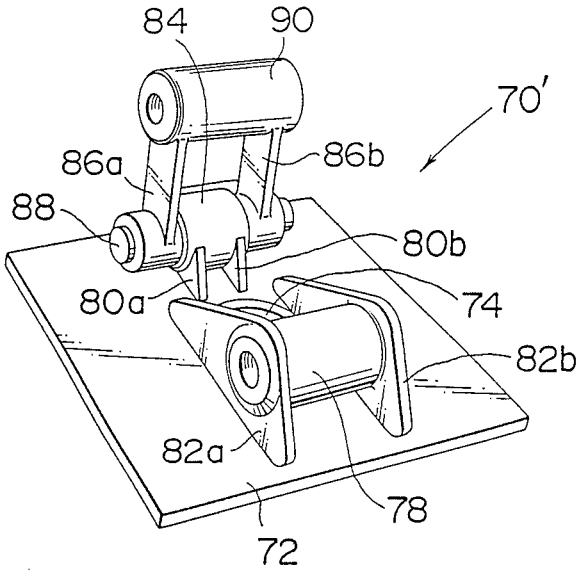
FIG. 4A is a perspective view of another mounting structure of the connector assembly shown in its reversed position for the sake of clarity.

FIG. 4A shows a modification of the mounting structure of the attachment mounting subassembly 70 upside down so that the structural 70' features thereof can be seen clearly. This modified mounting structure 70' is similar to that of FIG. 2 except that a boss 84 (corresponding to the boss 76 in the FIG. 2 embodiment) has a length substantially shorter than that of the mating boss 78. Located near the opposite open ends of the boss member 84 are connecting legs 86a and 86b, respectively. The connecting legs 86a and 86b have their one ends pivotally connected to the boss member 84 through a common pin 88 extending through the boss member 84, the other ends of the connecting legs being integrally joined to a hollow tubular member or boss 90 which is substantially identical to the boss member 78 and disposed in a manner to straddle the boss member 84. Again, as described wtih reference to FIG. 2, the open ends of the boss 90 may be substantially flush with the corresponding open ends of the boss 78.

Figure 4B:
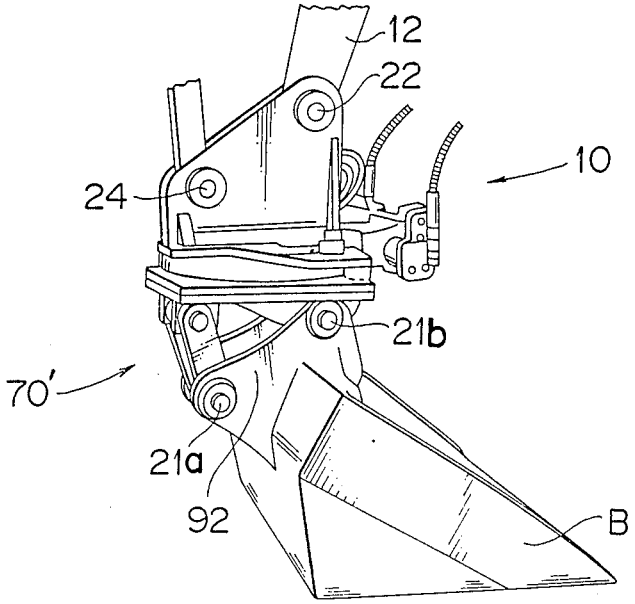
FIG. 4B is a perspective view, similar to FIG. 1, of the attachment connector assembly according to the present invention, with a bucket attached to the mounting structure of the connector assembly shown in FIG. 4A.

In FIG. 4B, a bucket B is shown as attached to the mounting structure 70' of FIG. 4A by placing the pins 21a, 21b through holes of the brackets 92 of the bucket suspension structure and also of the boss members 78 and 90 interposed therebetween. As will be appreciated to those skilled in the art, it would be advantageous to be able to adjust the length of each of the connecting legs 86a and 86b so that the bucket B can be positioned with its open material holding area generally facing upwardly because, in loading, transporting or off-loading materials such as ready mixed concrete, the bucket may not only be moved away from or pulled towards the excavator but also be rotated about the axis of rotation of the rotating element 50. It will be appreciated that due to the use of the connecting legs 86a and 86b the attachment mounting subassembly 70' shown in FIGS. 4A and 4B can accommodate any possible variations in spacing between the holes of the brackets of the bucket suspension structures.

Figure 5A:
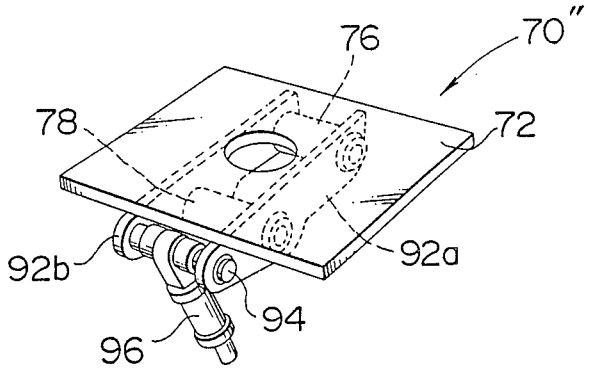
FIG. 5A is a perspective view of a third embodiment of the mounting structure of the connector assembly constructed in accordance with the present invention.

Turning to FIG. 5A, there is shown a mounting structure 70'' of a third embodiment of the attachment mounting subassembly. This mounting structure is different from that of FIG. 2 in that the boss members 76 and 78 are supported by common support brackets 92a and 92b spaced apart from each other by a predetermined distance and rigidly secured to the fitting plate member 72 and also in that a hydraulic cylinder 96 is pivotally connected to the support brackets 92a and 92b by means of a pin 94 extending therethrough. The rod of the hydraulic cylinder 96 is operatively connected to the pair of the movable jaws, as shown in FIG. 5B. The attachment mounting subassembly 70'' shown in FIG. 5A can be used with a grapple with no hydraulic cylinder incorporated therein.

Figure 5C:
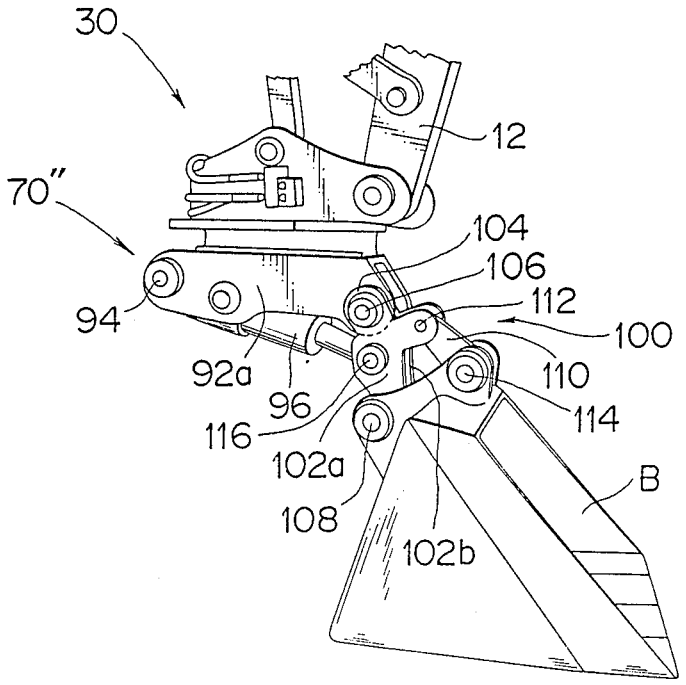
FIG. 5C is a perspective view of the attachment connector assembly according to the present invention, with a bucket being attached through an interconnecting device to the mounting structure shown in FIG. 5A.
Figure 5B:
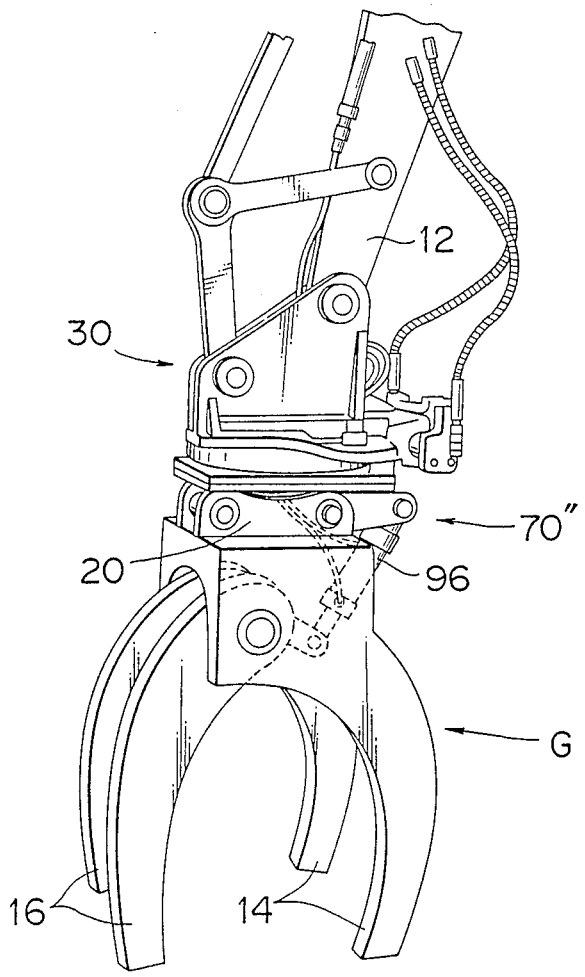
FIG. 5B is a perspective view of the attachment connector assembly according to the present invention, with a grapple having a hydraulic cylinder associated therewith being attached to the mounting structure shown in FIG. 5A.

Turning now to FIG. 5C, there is shown an optional device, generally indicated at 100, adapted for operative interconnection of the bucket B with the mounting subassembly 70'' shown in FIG. 5A. The interconnecting device 100 is composed of a pair of opposite levers 102a and 102b each formed preferably in the shape of a dog-leg having a suspension bracket 104 projecting therefrom at an appropriate point thereof. However, the pair of levers 102a and 102b may take any other form as desired, provided that it can perfectly perform the functions as described below. The brackets 104 of the levers 102a and 102b are fitted over the respective open ends of the boss member 76 of the mounting structure 70'' and pivotally connected thereto by means of a pin 106 extending through the suspension brackets 104 of the levers 102a and 102b and the boss member 76. The levers are rigidly interconnected at their respective one ends by a transverse hollow shaft or boss member (not shown) which in turn is connected to the bucket suspension structure by means of a pin 108 extending therethrough.

As shown, an adusting arm 110 is pinned at one end 112 to the pair of levers 102a and 102b and at the other end 114 to the suspension structure of the bucket through a tubular support member (not shown).

It will be appreciated that as in the embodiment shown in FIG. 4A, the adjuster arm 110 of the interconnecting device 100 of FIG. 5C can accommodate any variations in the spacing between the pin holes of the bucket suspension structure.

In FIG. 5C, the pair of levers 102*a* and 102*b* has a pivot pin 116 extending transversely therethrough between the mounting pins 106 and 108. Firmly secured to the pivot pin 116 is the rod of the hydraulic cylinder 96 of the attachment mounting subassembly 70″ so that the cylinder 96 when actuated can swing the pair of levers 102*a* and 102*b* in a counterclockwise direction as viewed in FIG. 5C about the pivot axis 106 within a range of angular displacement defined by the stroke of extension of the hydraulic cylinder rod, thus resulting in the corresponding angular displacement of the bucket B, in addition to the angular pivotal movement thereof about the pivot axis 22. In the illustrated embodiment, the pivot pin 116, i.e., a point at which the cylinder rod is connected to the pair of levers 102*a* and 102*b*, is situated along the length of the latter approximately midway between the pivot pin 106 and the mounting pin 108. With the pivot pin 116 on the levers 102*a* and 102*b* repositioned closer to the pivot axis 106, an increased angular displacement of the bucket B about the pivot axis 106 may be provided without increasing the length of the cylinder rod which would otherwise unduly project from the extent of the connector subassembly 70″ and interfere with the operation of the bucket in a limited working space. Viewed from a different aspect, for a given angular displacement of the bucket about the pivot axis 106, a required length of the cylinder rod may be reduced so that a cylinder unit of compact size can be used with added advantage of improved maneuverability of the bucket within the limited working space.

Numerous features and advantages of the invention have been set forth in the foregoing description, together with details of structure and function of the invention. The disclosure, however, is illustrative only, and changes may be made in detail without deviating from the true scope of the invention.

What is claimed is:

1. An attachment connector assembly for use with a hydraulic shovel type excavator including a stick arm or dipper stick wherein the attachment consists of a bucket with a suspension structure comprising a pair of bracket means having first and second sets of aligned, spaced apart holes formed therein, said connector assembly comprising:

connector head means connected to the excavator stick arm or dipper stick for controlled pivotal movement about a first axis;

rotating means mounted to the connector head means for rotation relative thereto about a second axis under the control of drive means operatively associated with the rotating means, the second axis extending substantially transverse to the first axis; and a mounting structure comprising a fitting plate member removably secured to the rotating means, a pair of parallel hollow boss means disposed in spaced apart relationship relative to each other and secured to the fitting plate, and a pair of leg means pivotally connected at respective one ends thereof through pivot pin means to one of the boss means at opposite sides thereof and having a hollow tubular member integrally joined to respective other ends of the leg means;

said bucket adapted to be attached to the mounting structure by means of a first mounting pin extending through the hollow tubular member of the mounting structure and the first set of the aligned holes of the bucket suspension structure and a second mounting pin extending through the other boss means of the mounting structure and the second set of the aligned holes of the bucket suspension structure;

said leg means each having a length selected to accommodate any variations in the spacing between the first and second sets of the aligned holes of the bracket means of the bucket suspension structure.

2. An attachment connector assembly according to claim 1, wherein said one of the boss means of the mounting structure has a length shorter than that of the other boss means.

3. An attachment connector assembly for use with a hydraulic shovel type excavator including a stick arm or dipper stick wherein the attachment consists of a bucket with a suspension structure comprising a pair of bracket means having first and second sets of aligned, spaced apart holes formed therein, said connector assembly comprising:

connector head means connected to the excavator stick arm or dipper stick for controlled pivotal movement about a first axis;

rotating means mounted to the connector head means for rotation relative thereto about a second axis under the control of drive means operatively associated with the rotating means, the second axis extending substantially transverse to the first axis;

a mounting structure comprising a fitting plate member removably secured to the rotating means and a pair of parallel hollow boss means disposed in spaced apart relationship relative to each other and secured to the fitting plate;

a hydraulic cylinder pivotally connected to the mounting structure and fluidly connected to a hydraulic fluid source, the hydraulic cylinder having an extendable and retractable piston rod operatively associated therewith; and means for interconnecting the bucket suspension structure with the mounting structure, said interconnecting means comprising lever means pivotally connected at one of the ends thereof to a first pin extending through said one of the boss means of the mounting structure and at the other end thereof to a second pin extending through the first set of the aligned holes of the bucket suspension structure, the piston rod of the hydraulic cylinder pivotally connected to the lever means at a point situated between the first and second pins so as to provide a pivotal movement of the bucket through the interconnecting means about said first pin during the extension or retraction of the piston rod of the hydraulic cylinder, said interconnecting means further comprising adjusting arm means pivotally connected at one of the ends thereof to the lever means and at the other end thereof to a third pin extending through the second set of the alligned holes of the bucket suspension structure for accommodating any variations in the spacing between the first and second sets of the aligned holes of the bracket means of the bucket suspension structure;

whereby during actuation of the hydraulic cylinder, said bucket and interconnecting means can be pivotally moved as a unit about said first pin extending through said one of the boss means of the mounting structure.

* * * * *